US008210114B2

(12) United States Patent
Nysether et al.

(10) Patent No.: US 8,210,114 B2
(45) Date of Patent: Jul. 3, 2012

(54) RUDDER ASSEMBLY

(75) Inventors: Mark A. Nysether, Arlington, WA (US); Matthew Poischbeg, Everett, WA (US); R. Lee Rawls, Woodinville, WA (US)

(73) Assignee: Sea-Dog Corporation, Everett, WA (US)

( * ) Notice: Subject to any disclaimer, the term of this patent is extended or adjusted under 35 U.S.C. 154(b) by 46 days.

(21) Appl. No.: 13/022,476

(22) Filed: Feb. 7, 2011

(65) Prior Publication Data

US 2011/0192334 A1 Aug. 11, 2011

Related U.S. Application Data

(63) Continuation of application No. PCT/US2009/053149, filed on Aug. 7, 2009.

(60) Provisional application No. 61/087,069, filed on Aug. 7, 2008.

(51) Int. Cl.
*B63H 25/06* (2006.01)
*B63H 25/38* (2006.01)

(52) U.S. Cl. ..... 114/162; 114/165

(58) Field of Classification Search ..... 114/39.15, 114/39.24, 127–143, 149, 152, 162–172
See application file for complete search history.

(56) References Cited

U.S. PATENT DOCUMENTS 3,575,124 A * 4/1971 Alter ..... 114/165
3,921,561 A * 11/1975 Arce ..... 114/165
3,922,988 A 12/1975 Caton
3,941,072 A 3/1976 Caton
4,088,088 A * 5/1978 Proctor ..... 114/165
4,372,241 A * 2/1983 Tritt ..... 114/162
4,556,006 A 12/1985 Kaupat
5,447,113 A 9/1995 Chernin
6,739,276 B1 5/2004 Rard

OTHER PUBLICATIONS

Cunningham, C., "Navigator Rudder System by Global Outfitters," Sea Kayaker 19(5):32, Dec. 2002.

Written Opinion and International Search Report mailed Mar. 23, 2010, issued in corresponding International Application No. PCT/US2009/053149, filed Aug. 7, 2009, 3 pages.

* cited by examiner

*Primary Examiner* — Ajay Vasudeva
(74) *Attorney, Agent, or Firm* — Christensen O'Connor Johnson Kindness PLLC

(57) ABSTRACT

A stop member (74; 174) is affixed to an elongated rudder blade (16) near its top and projects forward beyond the leading edge of the blade. A frame (62) in which the blade (16) is slidable lengthwise extends along a portion of the trailing edge of the blade and forward along the opposite sides. A separate mounting block (12) has a groove (48) receiving a portion of the leading edge of the blade (16). A pivot component (82) is mounted in the groove (48) for engagement against the underside (78) of the stop (74) when the blade (16) is in a normal upright steering position. A spring (52) is connected between the mounting block (12) and the frame (62) to bias the frame toward a position in which the blade (16) received therein extends in an upright steering position. From such position, the blade (16) can be swung upward and rearward, followed by forward translational movement through the frame (62) and along the mounting member (12).

13 Claims, 19 Drawing Sheets

RUDDER ASSEMBLY

CROSS-REFERENCES TO RELATED APPLICATIONS

This application is a continuation of International Application No. PCT/US2009/053149, filed Aug. 7, 2009, which claims the benefit of Provisional Application No. 61/087,069, filed Aug. 7, 2008, the entire disclosures of which are hereby incorporated by reference herein.

BACKGROUND

The present invention relates to a rudder assembly for a watercraft, particularly a personal watercraft, such as a kayak.

Known kayak rudders are almost always retractable. In the normal operating position, the rudder blade extends below the hull, at the stern, and is pivoted about an upright axis for steering control. For example, the rudder blade typically is carried by some type of mount that may have an upright stub shaft fitted in a bracket at the stern. The rotatable fit of the stub shaft in the bracket allows the rudder to be turned for steering the kayak. Typically, the rudder blade is pivoted to the mount for rotating upward about a horizontal axis so that it can be "retracted" out of the water. In some constructions, the arc or angle of retraction is 90 degrees, from a downward oriented, vertical position to an afterward oriented, horizontal position. In other constructions, the angle of retraction can be approximately 180 degrees, from a downward oriented, vertical position to an upward oriented, vertical position. In still other constructions, the angle of contraction is approximately 270 degrees, from a downward oriented, vertical position to a forward oriented, horizontal position (such as with the rudder blade resting on the stern portion of the watercraft). Another known construction is the so-called "Navigator Rudder System" described in an article from the December 2002 issue of *Sea Kayaker* magazine. In that system, a rudder blade is slidable in a sleeve, and it is the sleeve that is pivoted for swinging about a horizontal axis relative to a mount that, in turn, can be swung about a vertical axis. The blade can be retracted by sliding upward and forward through the sleeve as the sleeve rotates up, until the sleeve extends vertically and the rudder blade extends horizontally.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The rudder assembly in accordance with the present invention is quickly and easily mountable on the stern of a personal watercraft such as a kayak. Such assembly includes an elongated blade that can be swung side to side by conventional steering control lines. In a preferred embodiment, a stop member is affixed to the blade near its top and projects forward from the leading edge of the blade. A frame in which the blade is slideable lengthwise extends along a portion of the trailing edge of the blade and forward along the opposite sides. A separate mounting block has a groove receiving a portion of the leading edge of the blade. A pivot component is mounted in the groove for engagement against the underside of the stop member when the blade in its normal upright steering position. A spring is connected between the mounting block and the frame to bias the frame toward a position in which the blade received therein extends in the upright steering position. From such position, the blade can be swung upward and rearward, followed by forward translational movement through the frame and along the mounting member.

The blade and stop member can be adapted for connection at different locations along the leading edge of the blade, such that the depth of the blade below the mounting block can be adjusted. The stop member and mounting block can have cooperating portions permitting limited relative movement if the blade encounters an obstacle as the watercraft is moving rearward, and enclosed areas are provided for connection of standard steering control lines to the mounting block. The blade is not mechanically attached to the frame, nor is it mechanically attached to the mounting block, and the only attachment of the frame to the mounting block is by way of the spring.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
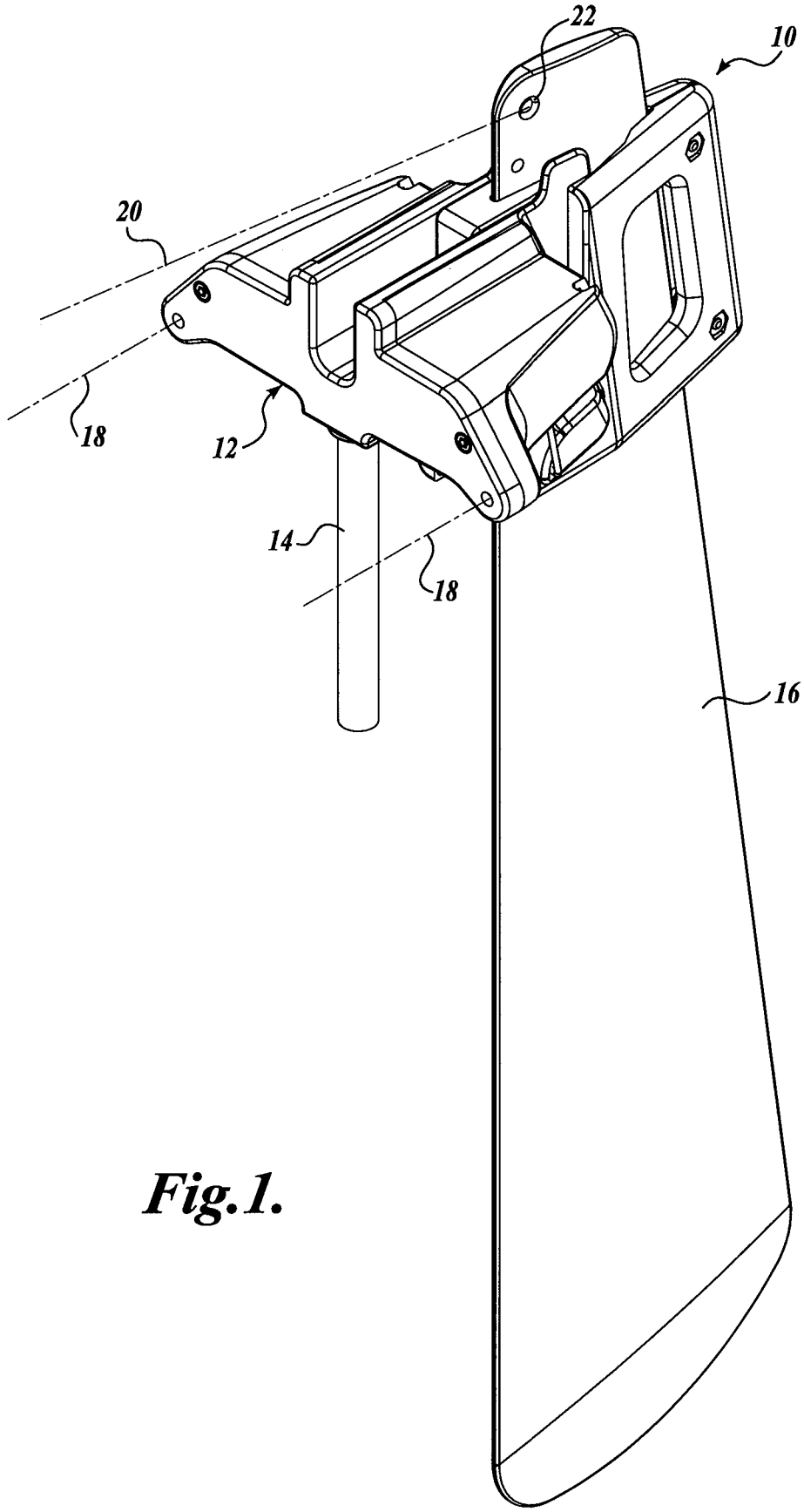
FIG. 1 is a top front perspective of a rudder assembly in accordance with the present invention.

FIG. 1 shows a rudder assembly 10 in accordance with the present invention in assembled condition, ready for mounting on a personal watercraft such as a kayak. The assembly includes a mounting block or base 12 from which an upright pivot shaft 14 extends downward. Shaft 14 is received in a standard mount, such as a mounting bracket, at the stern of the watercraft. In the steering position shown, the rudder blade 16 is supported by the base 12 but is not mechanically connected to it. From the central position illustrated in FIG. 1, the blade 16 can be swung to one side or the other by manipulation of rudder control lines 18. For example, in conventional kayaks it is common for such lines to be movable by operation of foot pedals or braces for steering the kayak. In general, in the construction of the present invention, the blade also can be swung upward about a transverse horizontal axis to an approximately horizontally-extending position by pulling on a rope or cable 20 that attaches to a mounting hole 22 at the top end portion of the blade 16. From the upward-swung, horizontal position, additional pulling on the rope or cable 20 results in translating the rudder blade forward relative to the mounting base 12.

Figure 2:
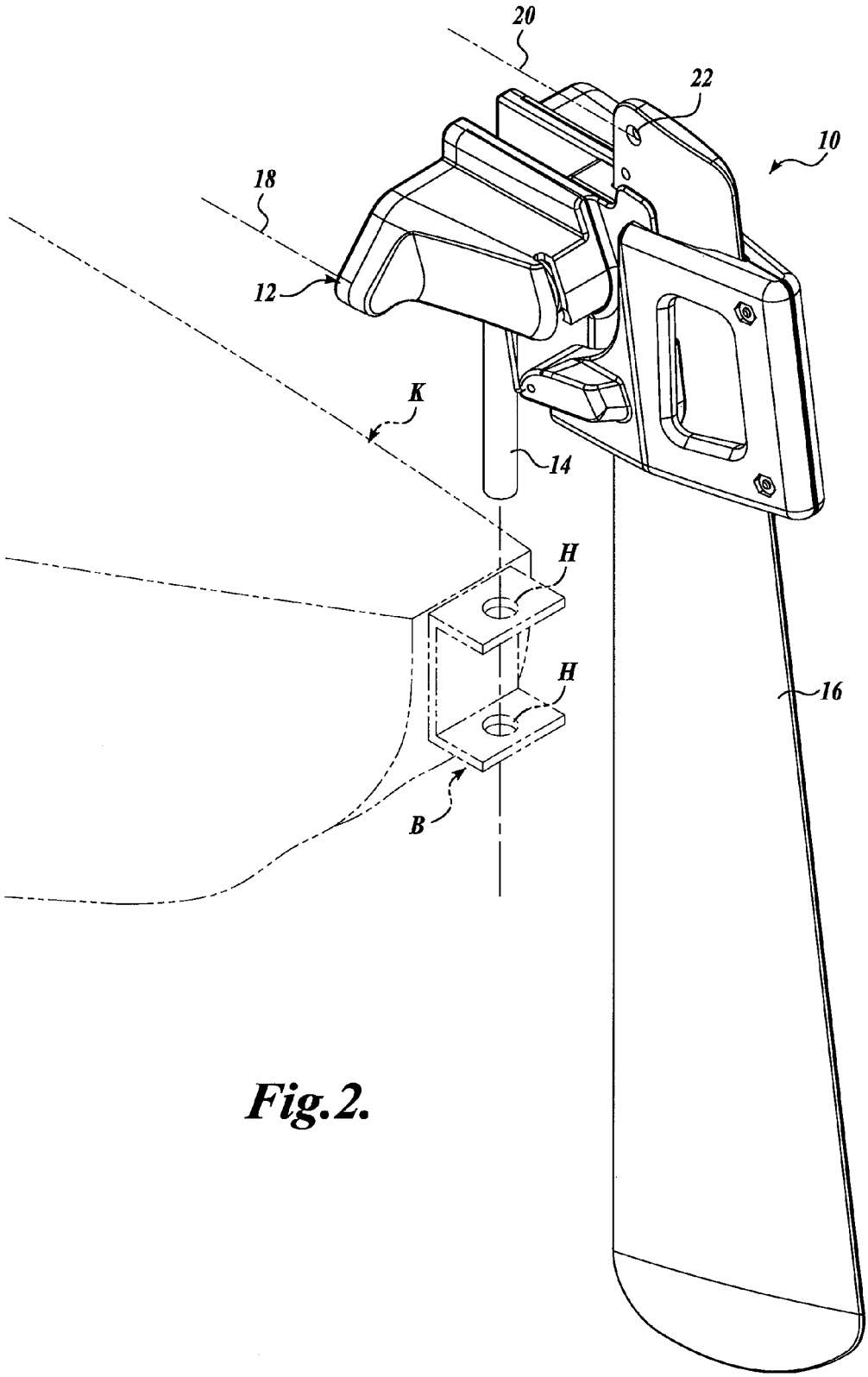
FIG. 2 is a top rear perspective of such rudder assembly with the stern portion of a personal watercraft shown in broken lines.

FIG. 2 also shows all of the component parts of the rudder assembly 10 assembled and with the rudder blade 16 in its lowered, upright steering position. The stern position of a kayak K and the rudder mounting bracket B are shown diagrammatically in broken lines. The bracket has vertically aligned holes H that rotatably receive the shaft 14 so that the base 12 and rudder blade 16 can be swung side-to-side for steering.

FIGS. 3-6 show parts of the rudder assembly removed or broken away. The component parts are symmetrical about a central vertical plane, such that the starboard and port side parts are minor images of each other.

Figure 3:
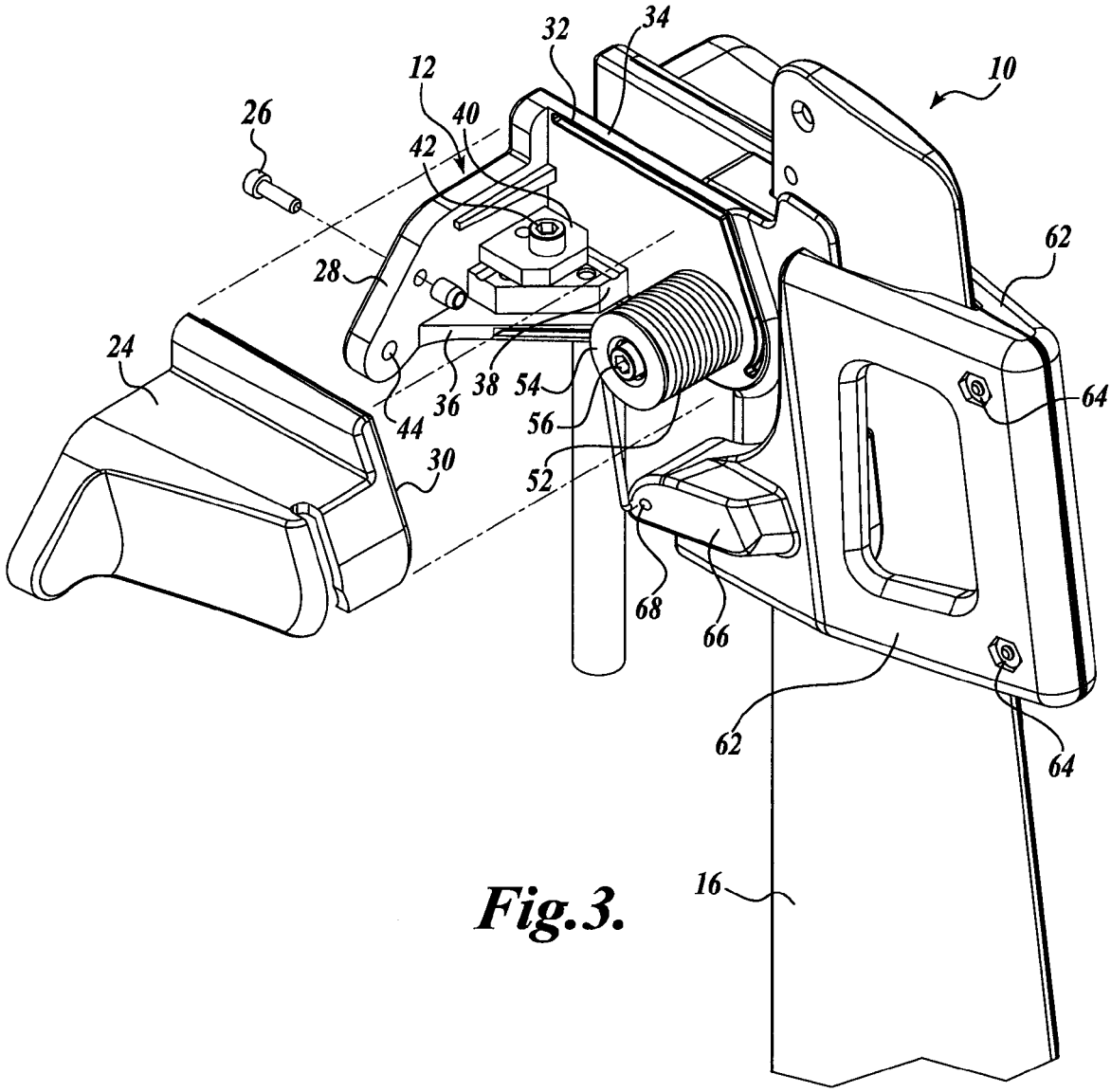
FIG. 3 is a fragmentary, enlarged, top rear perspective of such rudder assembly with parts shown in exploded relationship.

With reference to FIG. 3, a decorative and protective cap piece 24 is secured to the mounting base 12, such as by a screw 26 that extends through an upright front flange 28 of the mounting base. For additional stability, another attachment screw can be used at the center or rear portion of the cap. In the illustrated embodiment, the inner edge of the top and rear walls of the cap 24 have short tongues 30 that mate with shallow grooves 32 in a central wall 34 of the mounting base 12. Although a mating tongue-and-groove arrangement is illustrated, it is envisioned that pins and sockets could be used for the interfitting parts of the cap and central wall 34. An integral triangular gusset 36 extends between the lower portions of the front flange 28 and wall 34. The gusset carries a pair of clamp blocks 38, 40 that are connected by a screw 42. The aft end portion of the steering cable is clamped between these blocks and, from the clamping point, extends outward to a hole 44 in the front flange 28, and from there forward to the kayak steering mechanism. The cap and mounting block provide an enclosed area for connection of the steering control line.

Figure 4:
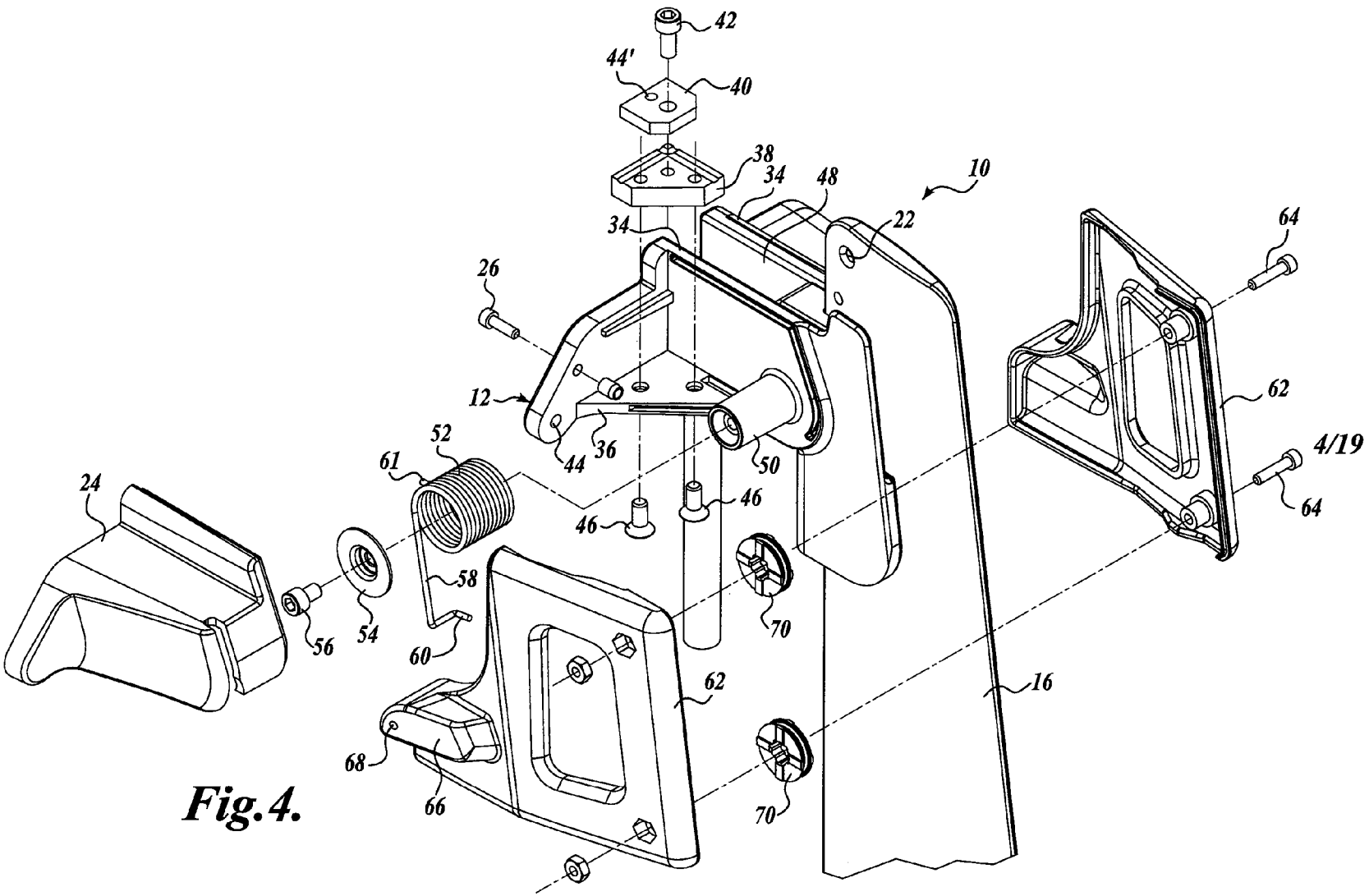
FIG. 4 is a corresponding top rear perspective of such rudder assembly with additional parts shown in exploded relationship.

More specifically, as seen in FIG. 4, the lower clamp block 38 can be secured on the gusset 36 by pins or screws 46. The top clamp block 40 has a hole for the clamping screw 42 and can have an additional hole 44' through which the end of the steering cable can be threaded. This allows for some adjustment in the steering cable and also convenient access for holding it in position as it is clamped between the blocks.

Figure 5:
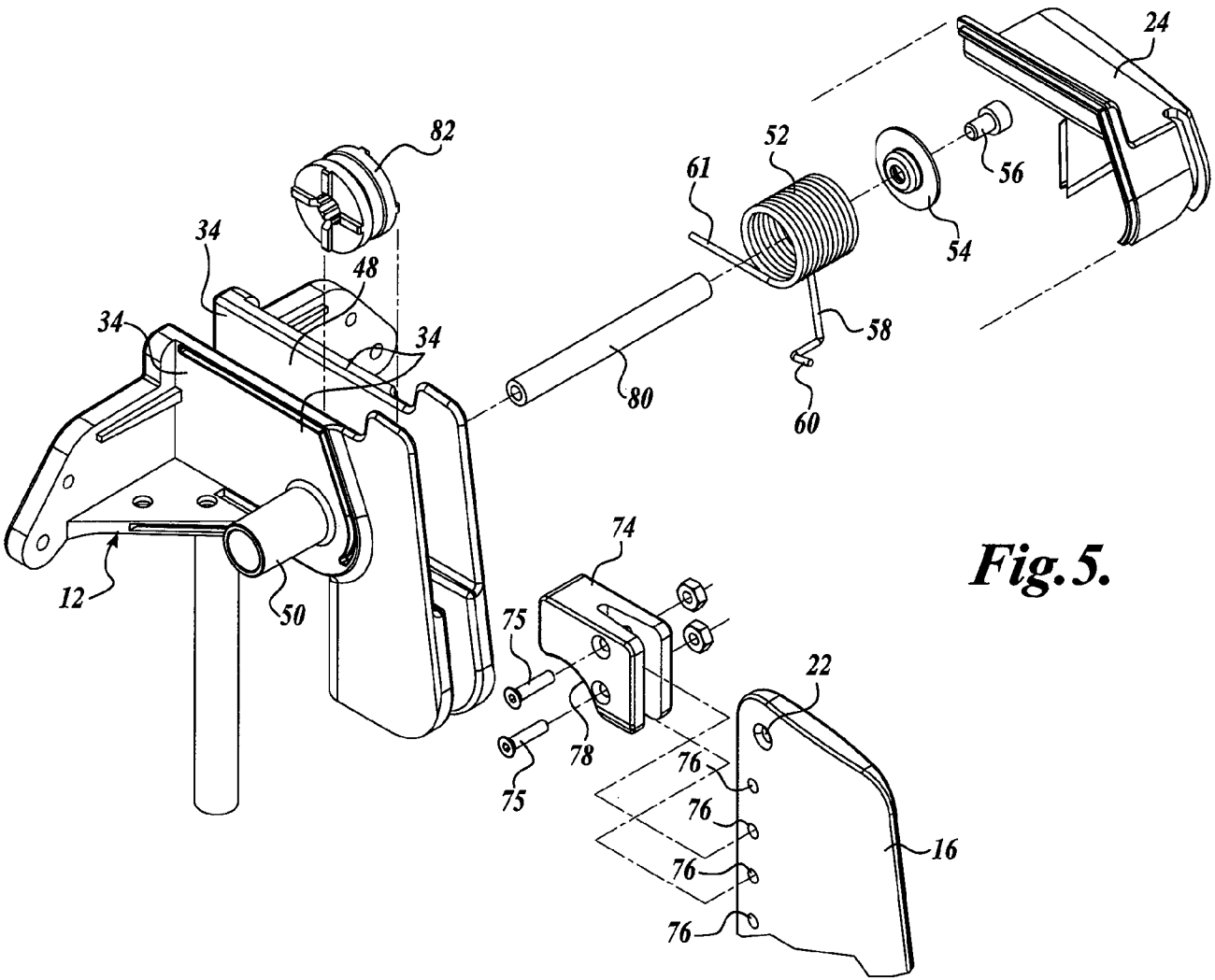
FIG. 5 is another corresponding top rear perspective of such rudder assembly with parts deleted and additional parts shown in exploded relationship.

With reference to FIG. 4 and FIG. 5, the central walls 34 of the mounting base 12 are spaced apart to form an upward-opening groove 48. The groove is also open at the front and to the rear of the base 12. Each wall 34 has a lateral cylindrical stub 50 for mounting of a helical torsion spring 52. Mounting can be by a retainer washer 54 and screw 56 (the port spring 52 being shown in its mounted position in FIG. 3). These parts (spring 52, retainer 54, and screw 56) are shown in exploded relationship at the port side in FIG. 4 and at the starboard side in FIG. 5. Each torsion spring 52 has a downward extending spring arm 58 with an in-turned end 60 at the bottom and a horizontal spring arm 61 that extends forward. The forward spring arm engages against the gusset 36, previously described. As described in more detail below, the biasing force of the downward-extending spring arm 58 is generally forward to urge a frame in which the rudder blade 16 is received toward the upright steering position for the rudder blade.

As seen in FIG. 3 and FIG. 4, at the rear of the rudder assembly 10, a pair of frame pieces 62 are connected together, such as by screws 64. The frame pieces 62 have front extensions 66 that, in the orientation shown in FIG. 3, for example, extend below the corresponding torsion springs 52. The in-turned end 60 of each spring is received in a hole 68 through the corresponding extension 66. An alternative connection can be achieved by forming the bottom end of the spring into an eye and attaching the spring to the extension 66 by a screw. The springs are the only attachment of the frames 62 to the mounting base 12. When the frames are joined together, they form a vertical slot receiving the upper rear portion of the rudder blade 16. This slot is aligned with the slot 48 in the rear portion of the mounting base.

In FIG. 4, the frame members 62 are illustrated in an outward-shifted position to reveal a pair of rollers 70 that are fitted between the frame members with central grooves that ride along the rear edge of the rudder blade 16. The rollers are coaxial with the frame screws 64.

In FIG. 5, the rudder blade 16 has been moved rearward out of the groove 48 in the rear of the mounting base 12. A stop block 74 is carried on the leading edge portion of the blade 16. The stop block 74 can be attached by screws 75, and a row of mounting holes 76 can be provided along the top portion of the blade such that the length of the blade below the block 74 can be adjusted by selecting the appropriate pair of mounting holes 76. The stop block projects forward from the leading edge of the blade, which otherwise is straight. The underside of the block 74 has an arcuate cut-out 78, preferably a quarter circle, i.e., approximately 90° and circular.

Figure 6:
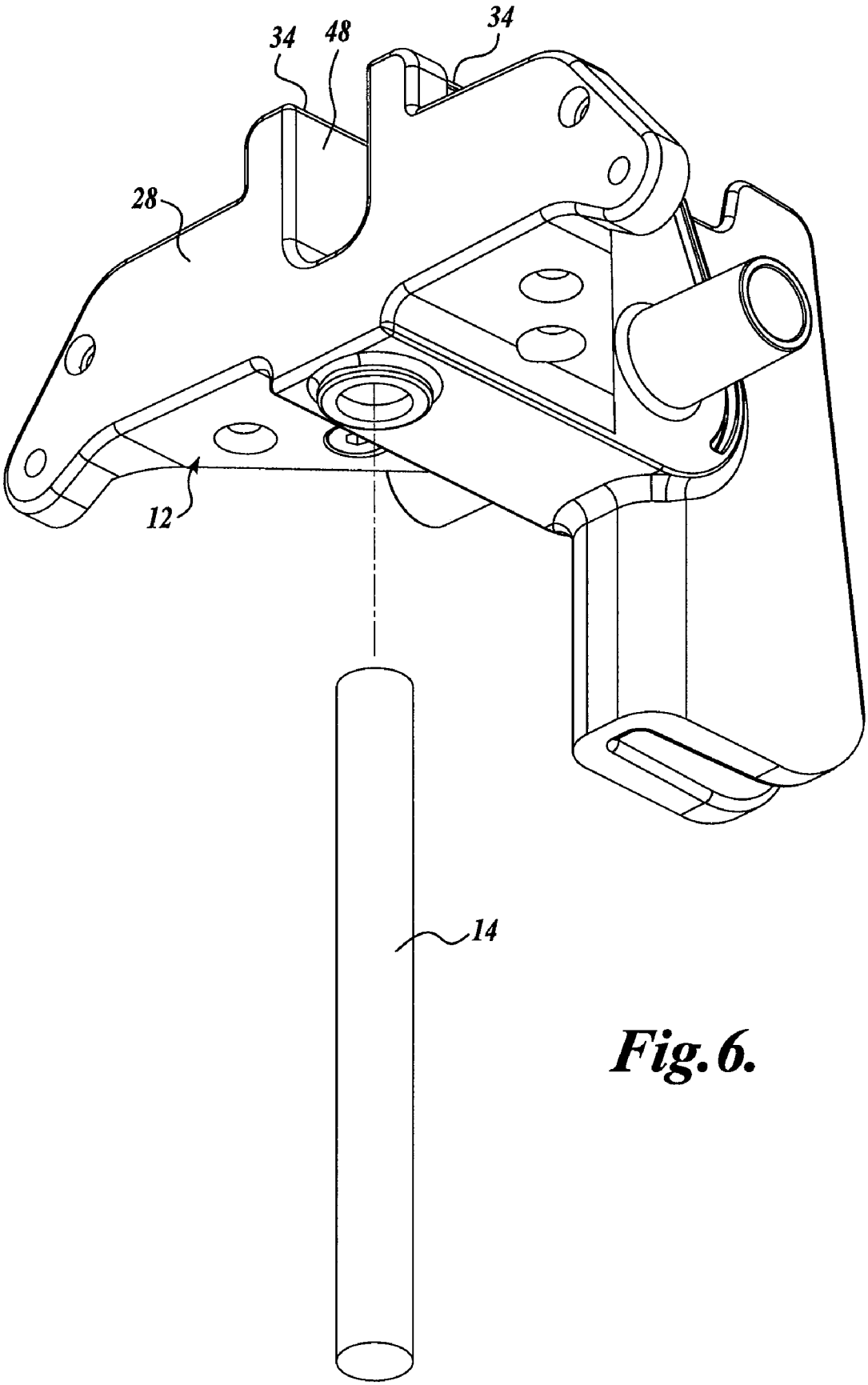
FIG. 6 is a bottom front perspective of such rudder assembly with parts deleted and parts shown in exploded relationship.
Figure 7:
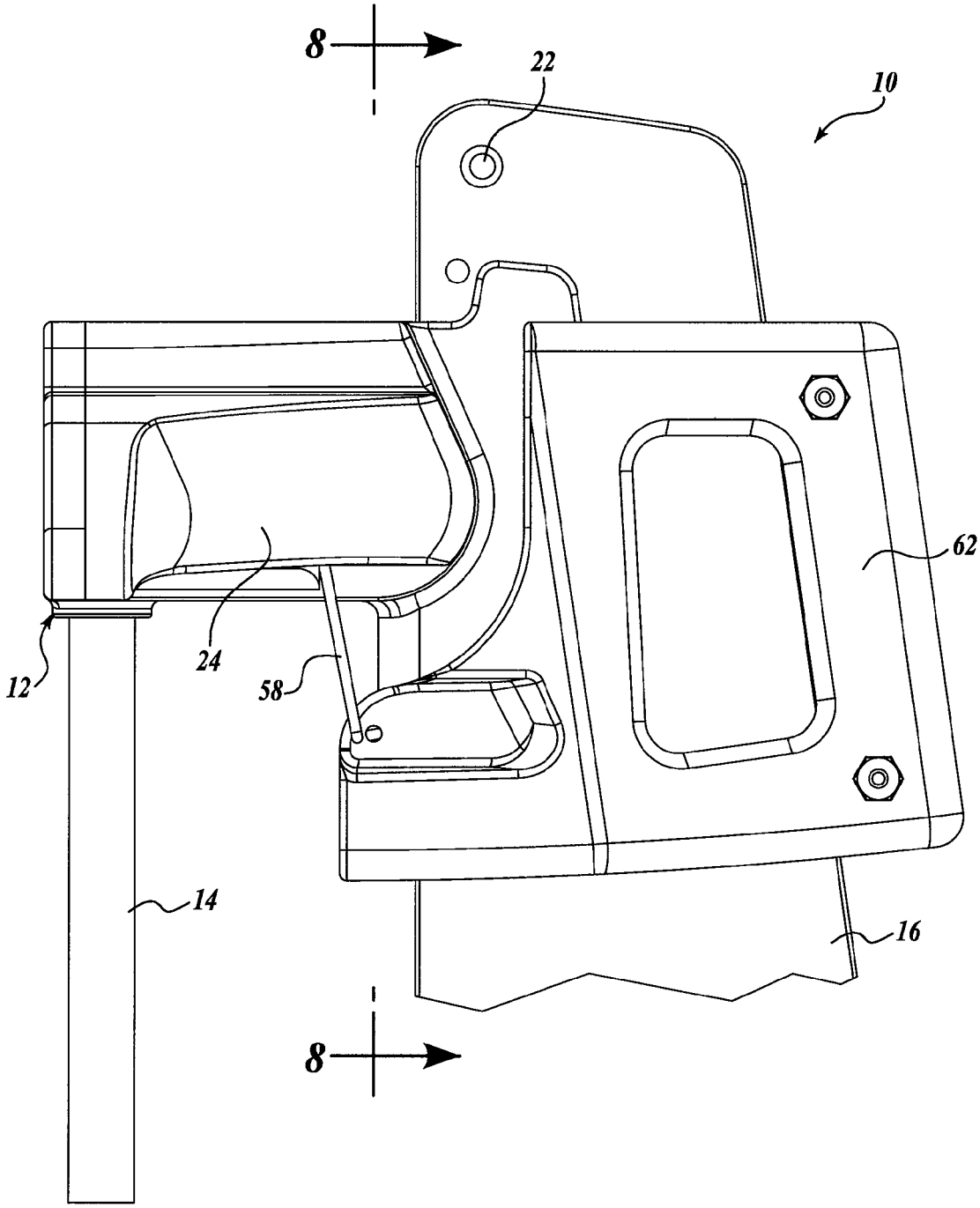
FIG. 7 is an enlarged, fragmentary side elevation of such rudder assembly.

FIG. 6 shows the base 12 from below with the stub shaft 14 shifted down. When assembled, the upper end portion of the shaft is permanently fixed in a socket that extends up through the bottom of the mounting base 12. For example, the upper end of the shaft can be received in a bushing that is overmolded in the base 12, and then secured from the top by a screw.

Figure 8:
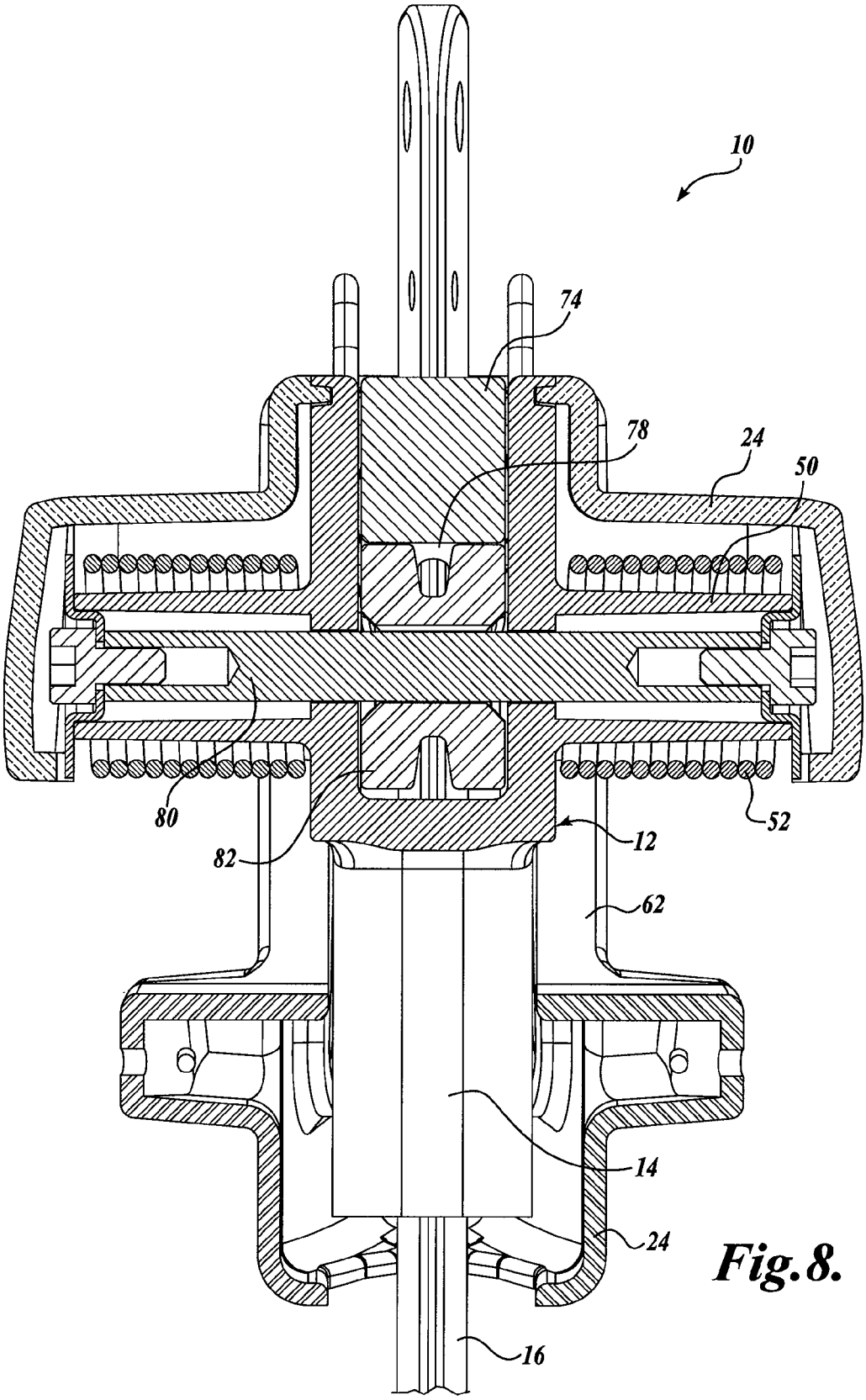
FIG. 8 is a section along line 8-8 of FIG. 7.

Returning to FIG. 5, an internal part of the rudder assembly includes a horizontal shaft 80 and a central pivot member in the form of a roller or pulley 82. Shaft 80 extends through the aligned stubs 50 and the roller 82 is received in the central portion of the groove 48 formed between the upright walls 34. The curvature of the exterior of the roller or pulley 82 is approximately the same as the cut-out 78 of the stop 76 which is affixed to the rudder blade 16. In normal use (i.e., the steering condition), the cut-out 78 of the stop 74 rests on the roller 82 as seen, for example, in the sectional, assembled view of FIG. 8.

Figure 9:
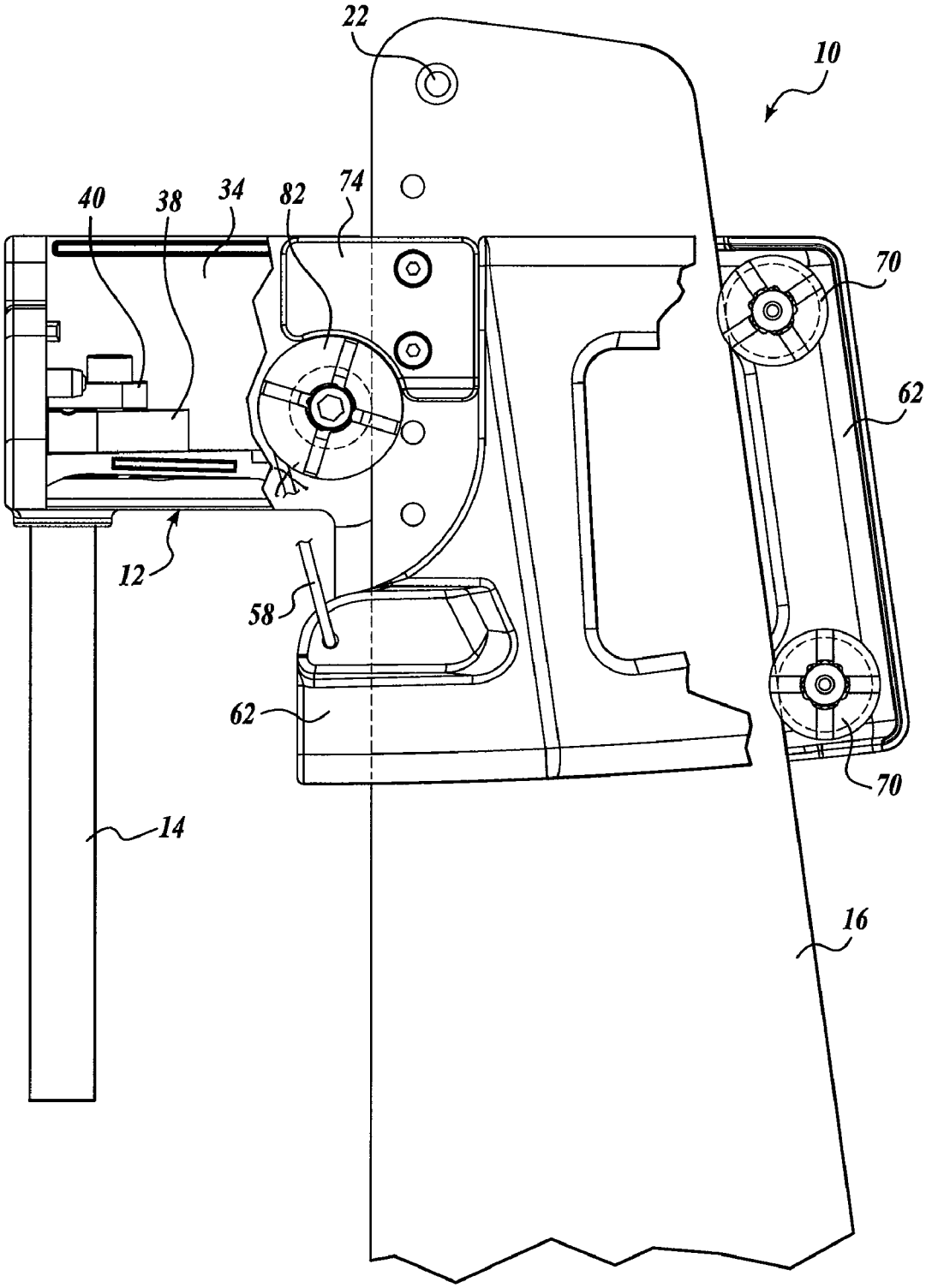
FIG. 9 is a side elevation of such rudder assembly, corresponding to FIG. 7, but with parts broken away.
Figure 10:
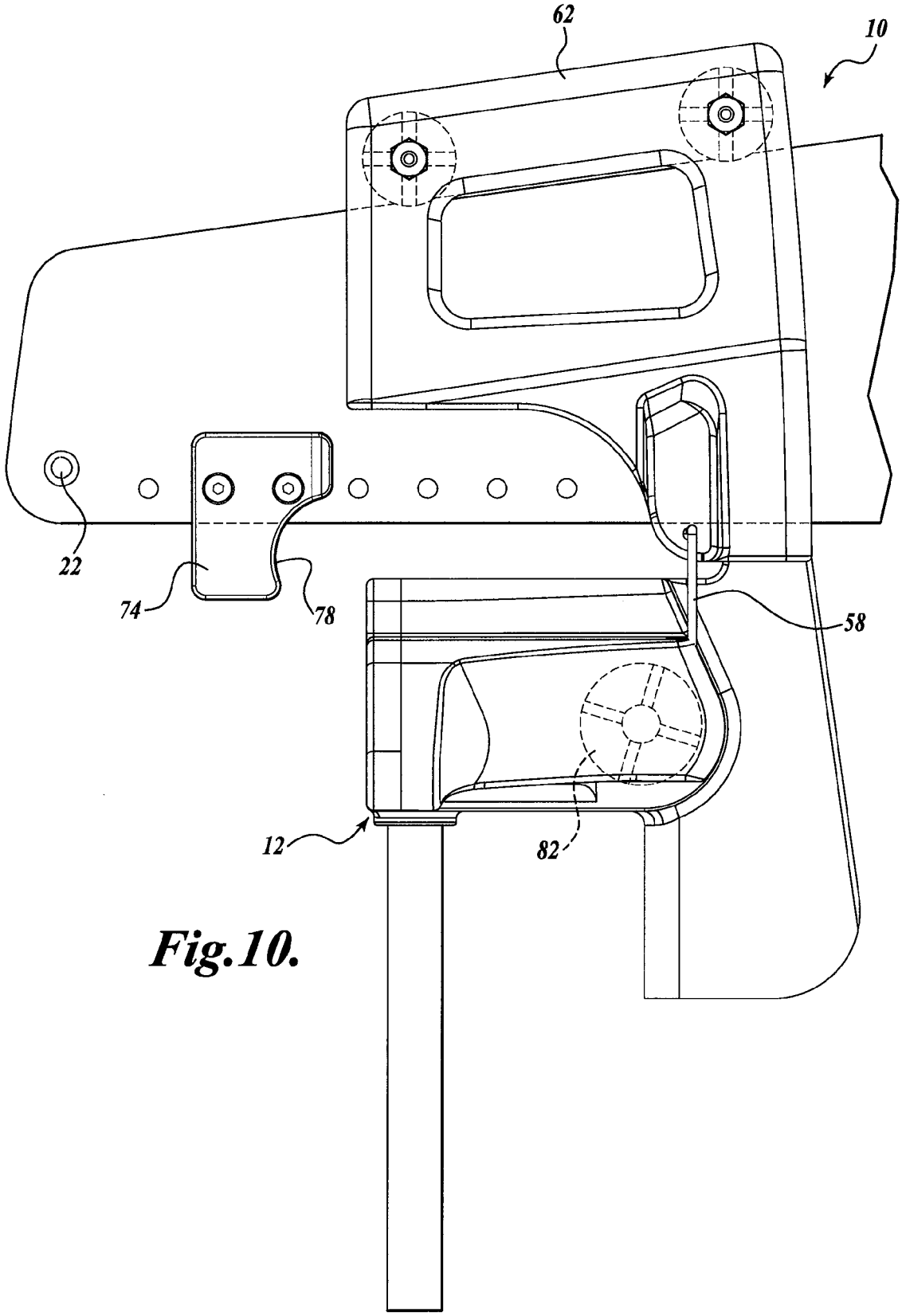
FIG. 10 is another corresponding side elevation of such rudder assembly with parts shown in different positions.

FIGS. 7, 9, 10, and 11 show the rudder assembly in elevation from the port side. In FIG. 9, the port cap piece is deleted to reveal the forward part of the central wall 34 at the port side and the downward-extending spring arm 58 connected to the lower front portion of the port frame piece 62. The rear portion of the port wall 34 is broken away to reveal the rudder stop 74 on the central roller 82. With the rear of the port frame piece 62 broken away, additional internal components can be seen, including the rear rollers 70 that are carried between the frame members 62. Note that there is no mechanical connection of the rudder blade and stop to the remainder of the assembly, and that the only connection of the composite frame formed by pieces 62 is by way of the torsion spring.

Figure 11:
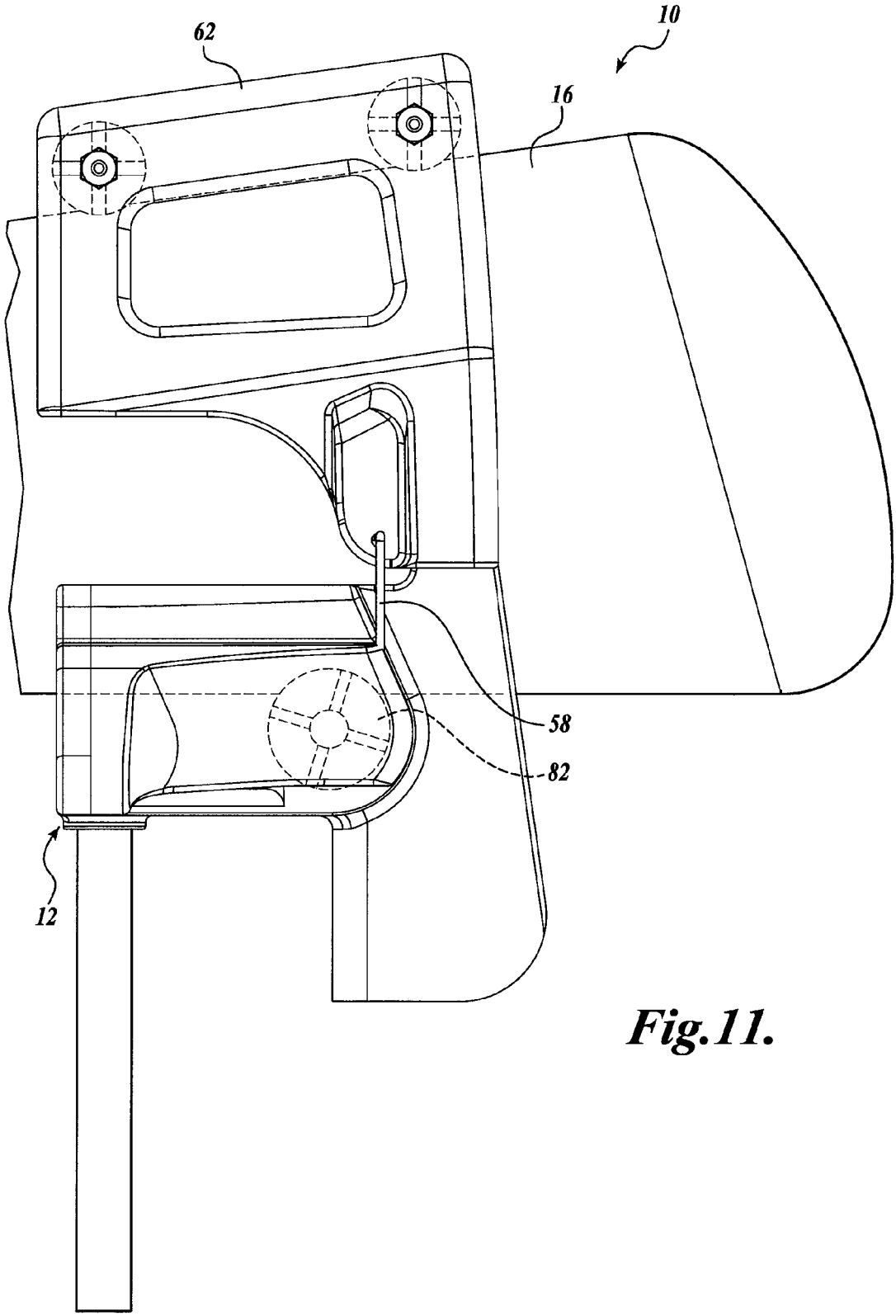
FIG. 11 is another corresponding side elevation of such rudder assembly with parts shown in different positions.
Figure 12:
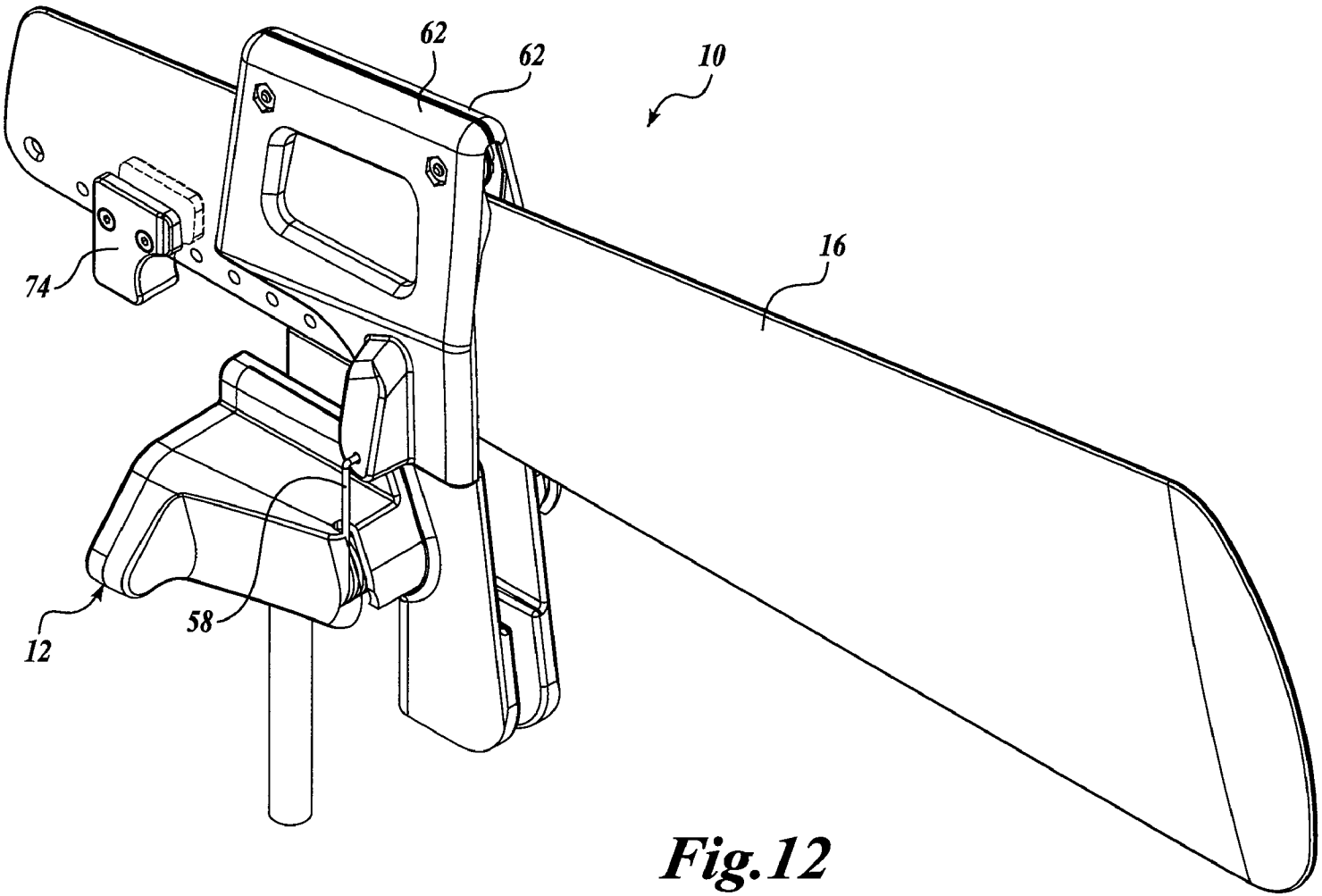
FIG. 12 is a top rear perspective of such rudder assembly with a rudder blade shown partially retracted.
Figure 13:
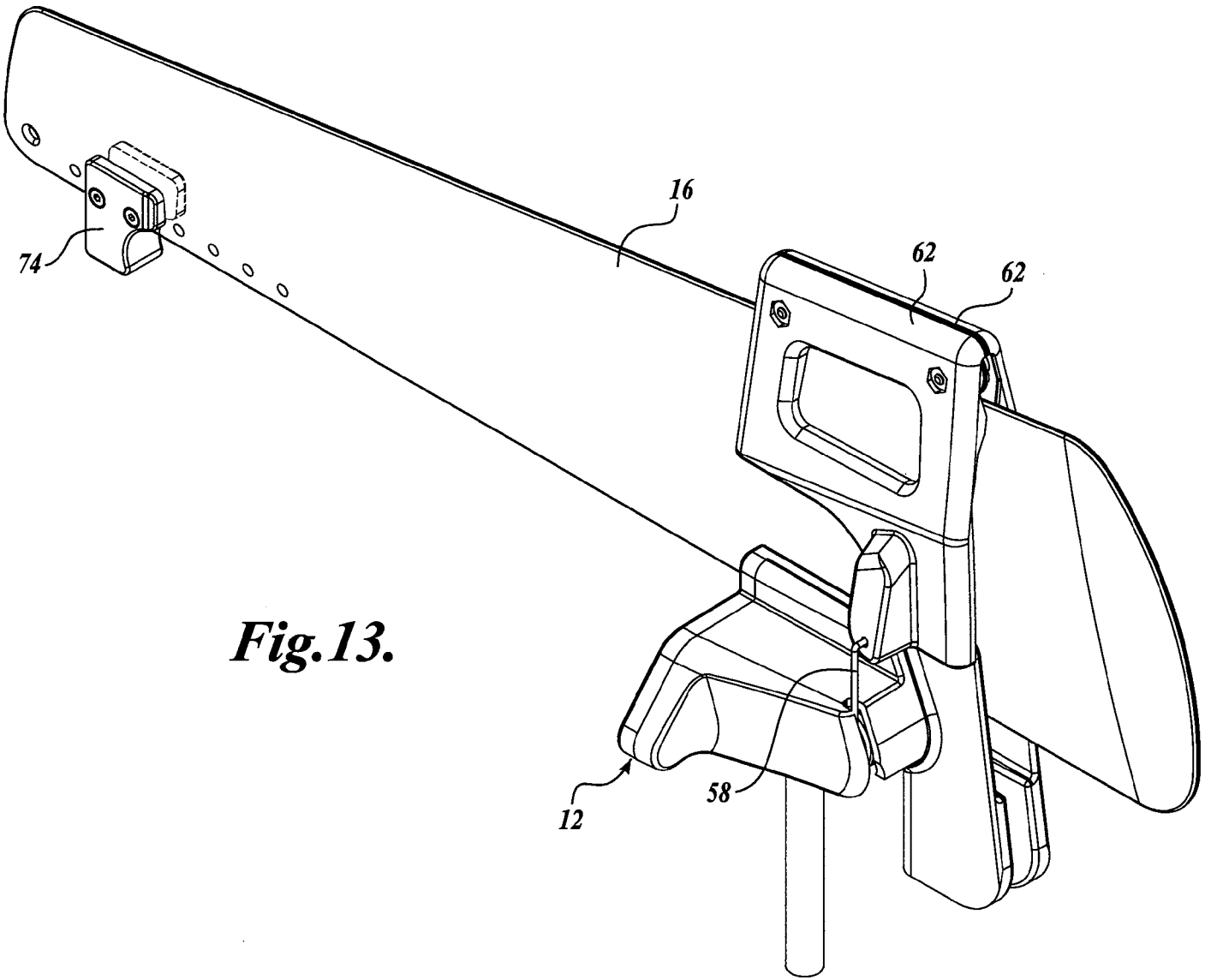
FIG. 13 is a corresponding top rear perspective of such rudder assembly with the rudder blade shown further retracted.
Figure 14:
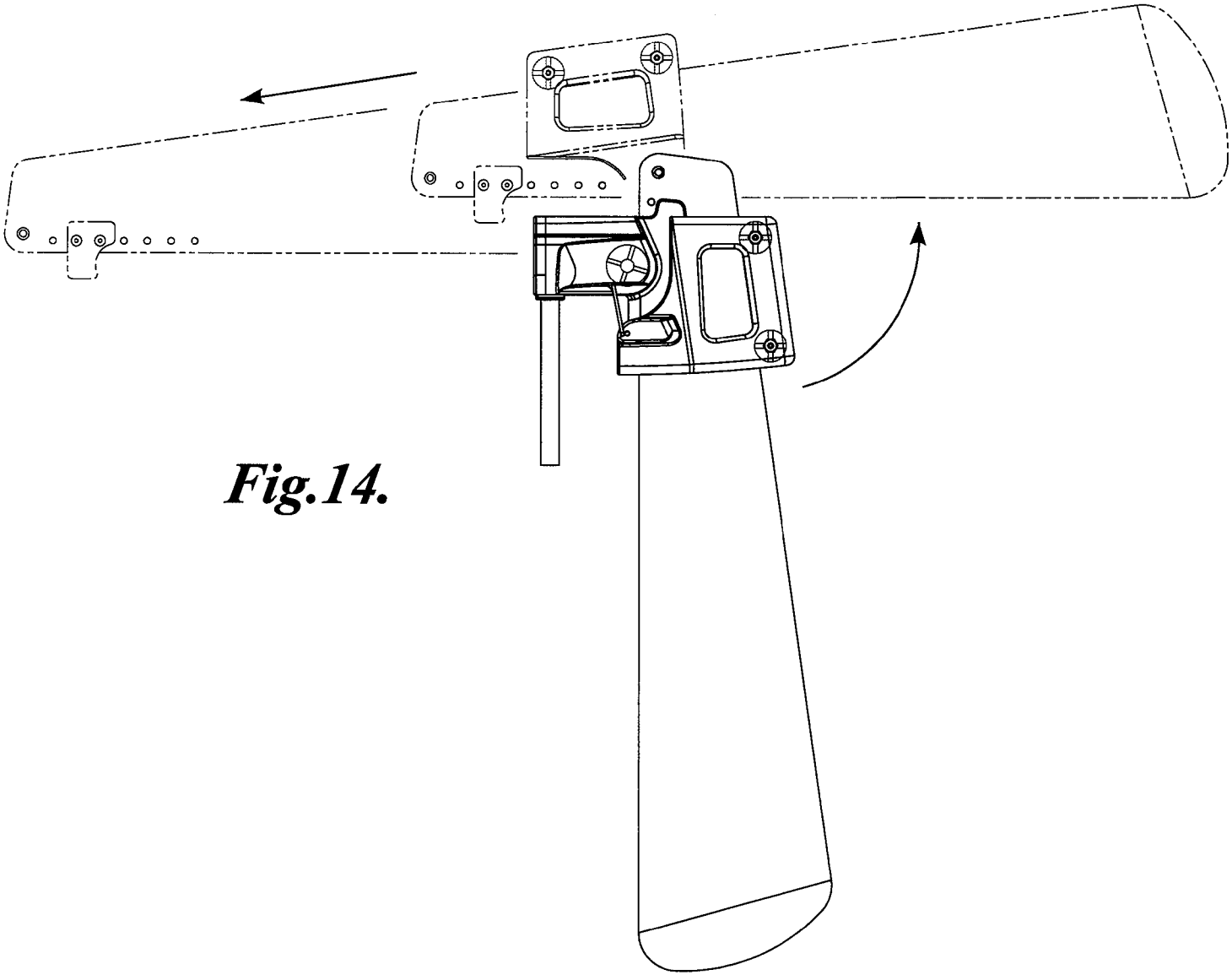
FIG. 14 is a diagrammatic side elevation of such rudder assembly with different positions of the parts shown in broken lines.
Figure 15:
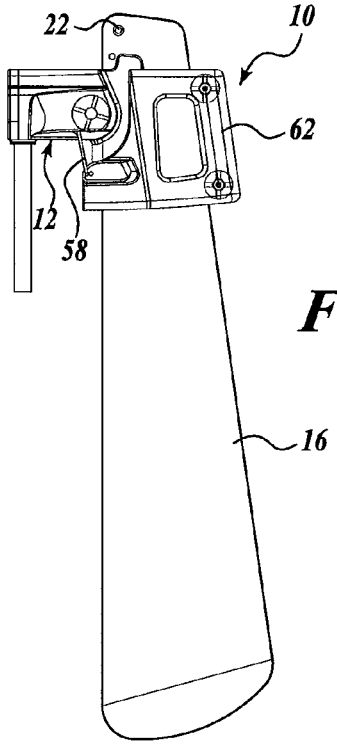
FIG. 15 is a side elevation of such rudder assembly.
Figure 16:
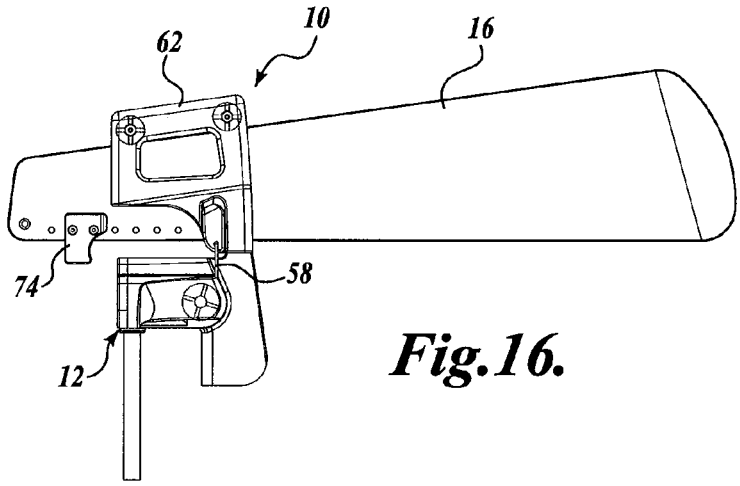
FIG. 16 is a corresponding side elevation of such rudder assembly with parts in different positions.
Figure 17:
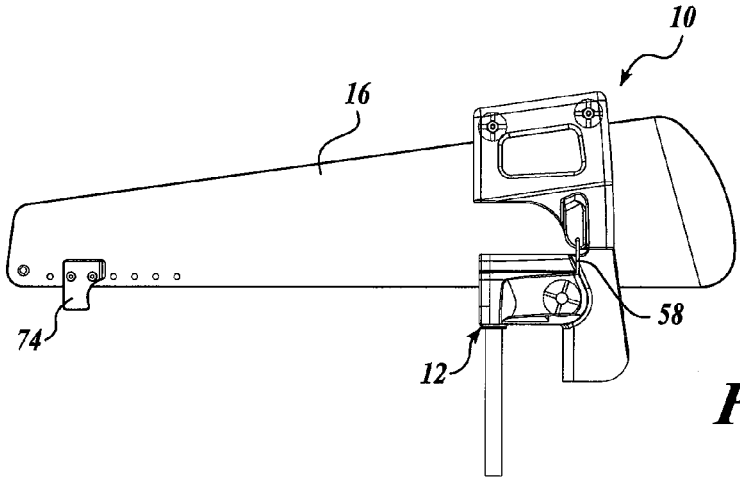
FIG. 17 is another corresponding side elevation of such rudder assembly with parts shown in different positions.

In normal use, the rudder blade 16 is supported on the roller 82 by engagement of the stop block 74 against the roller. When it is desired to raise the rudder, pulling forward on the rope or cable connected at 22 will swing the rudder blade and rear frames counterclockwise to the horizontal orientation shown in FIGS. 10, 12, and 16, against the biasing force of the torsion springs. Such biasing force is transmitted by way of the spring arms 58. Additional pulling on the rope or cable connected at 22 will translate the rudder horizontally forward to the position of FIGS. 11, 13, and 17. Since the back edge of the rudder blade is angled, i.e., the rudder increases in width from its top to its bottom, such forward translating shifts the rear frame pieces 62 upward. The rotation of the frame and the forward translation of the rudder blade are resisted by the force of the torsion spring on the frame pieces. FIGS. 11, 13, and 17 show the forward-most position contemplated with the base of the rudder almost fully retracted into the space between the frame members 62 and the frame members shifted upward to the maximum degree permitted by the torsion springs. The blade can be retained in the raised, forward-translated position by securing the control rope or cable in a cleat. Upon release of the control rope or cable the rudder automatically slides rearward and swings down to the upright steering position due to the force of the torsion springs.

Figure 18:
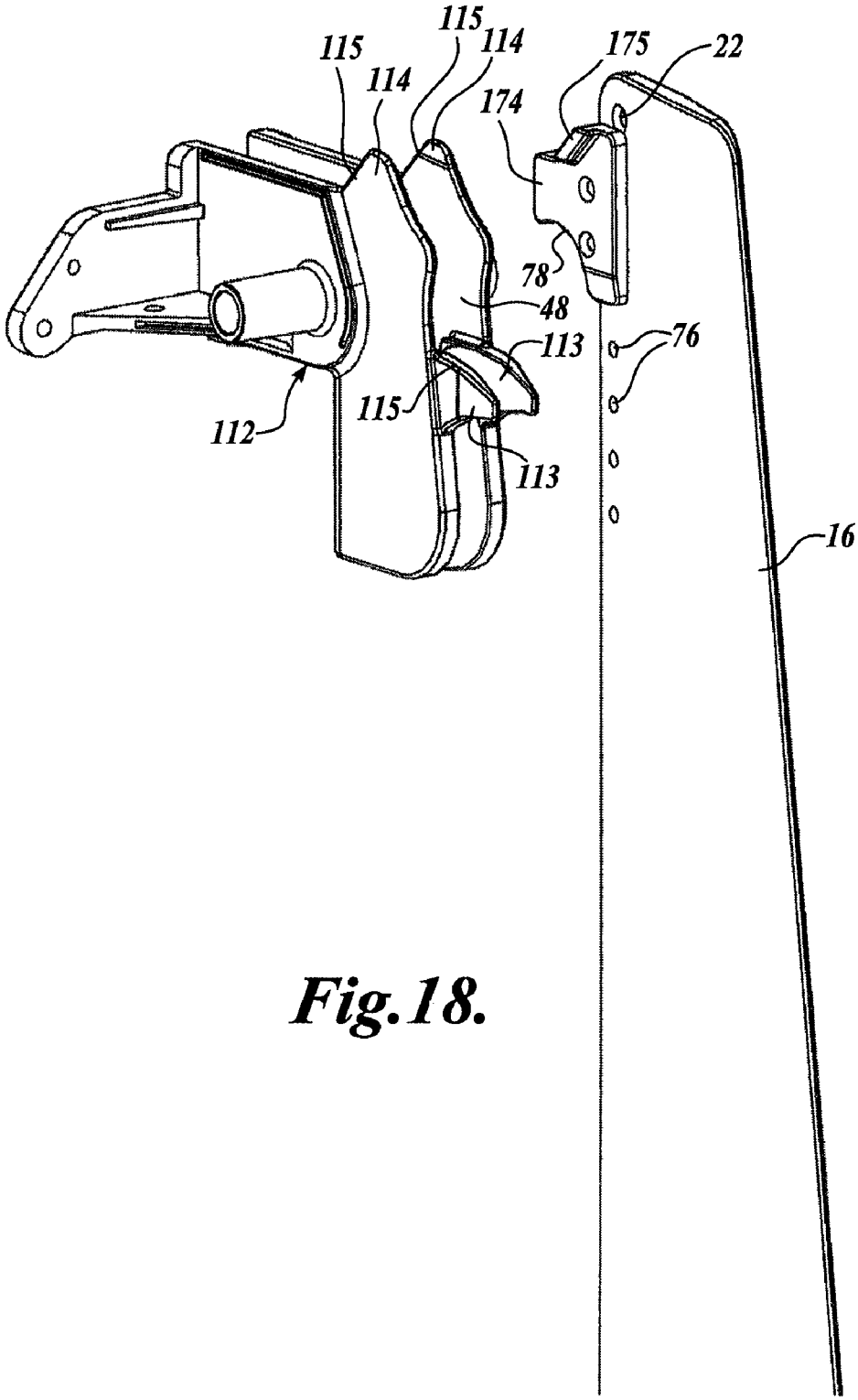
FIG. 18 is a top rear perspective of modified parts of a rudder assembly in accordance with the present invention.

FIG. 18 shows a modified mounting block or base that cooperates with a modified blade stop in an alternative embodiment of the present invention. Except for the modifications discussed herein, the alternative embodiment is identical to the embodiment previously described. The modified blade stop 174 attaches to the rudder blade 16 and has the same arcuate cut-out 78 as in the previous embodiment. Attachment of the stop 174 along the leading edge of the blade is by screws, and the depth of the blade is adjustable by selecting different mounting holes 76. A new feature of the stop is an outward projecting, inclined flange 175 at each side of the stop. The flange is inclined upward and rearward at an angle of approximately 45°.

The modified base 112 is identical to the base previously described except for the provision of integral tail pieces 113 that project rearward at each side of the central slot 48, at a location slightly below the roller on which the cut-out 78 rests; and in the provision of projecting portions 114 at the top of the mounting block base, above and to the rear of the roller location. Projecting portions 114 have inclined leading edges 115 which, like the stop flanges 175, are angled upward and rearward at an angle of about 45°.

Figure 19:
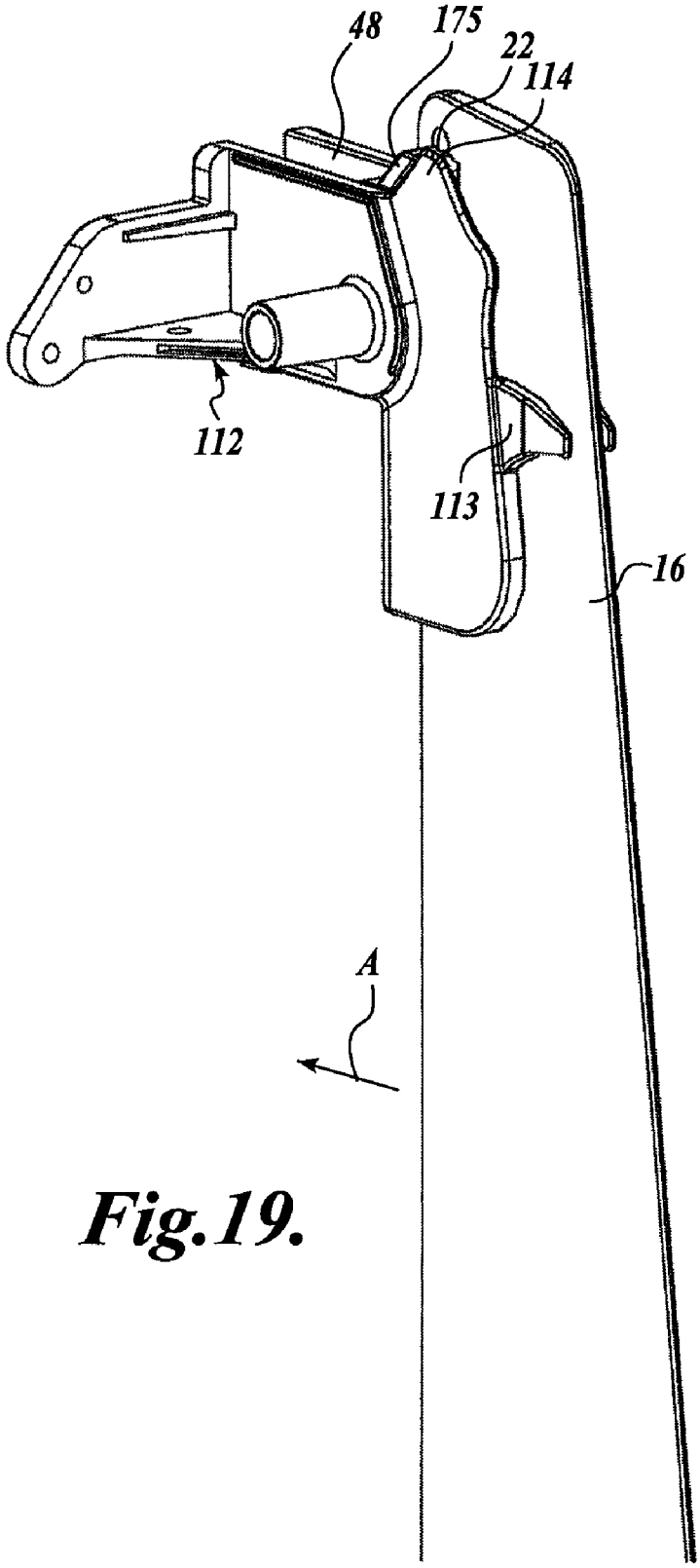
FIG. 19 is a corresponding top rear perspective with parts in different positions.
Figure 20:
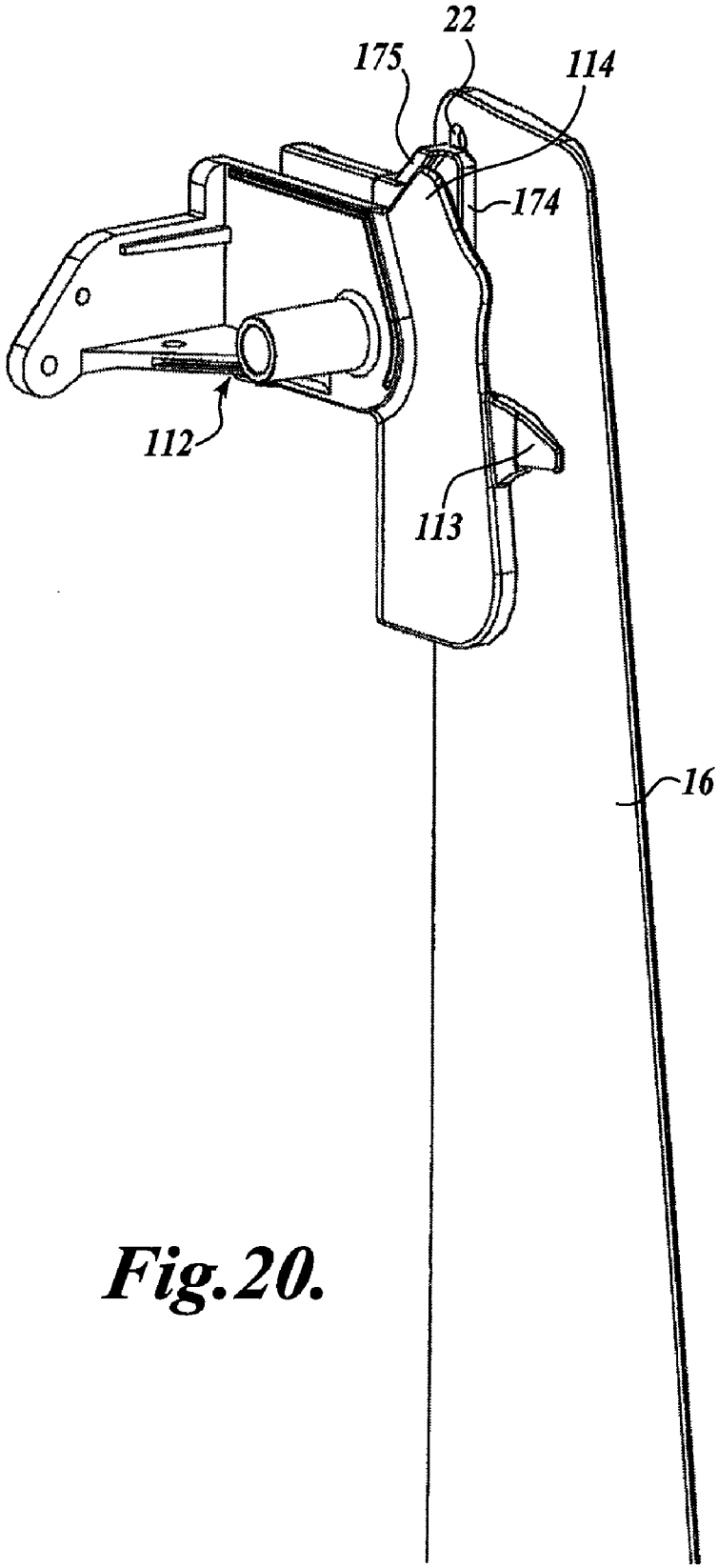
FIG. 20 is another corresponding top rear perspective with parts in different positions.
Figure 21:
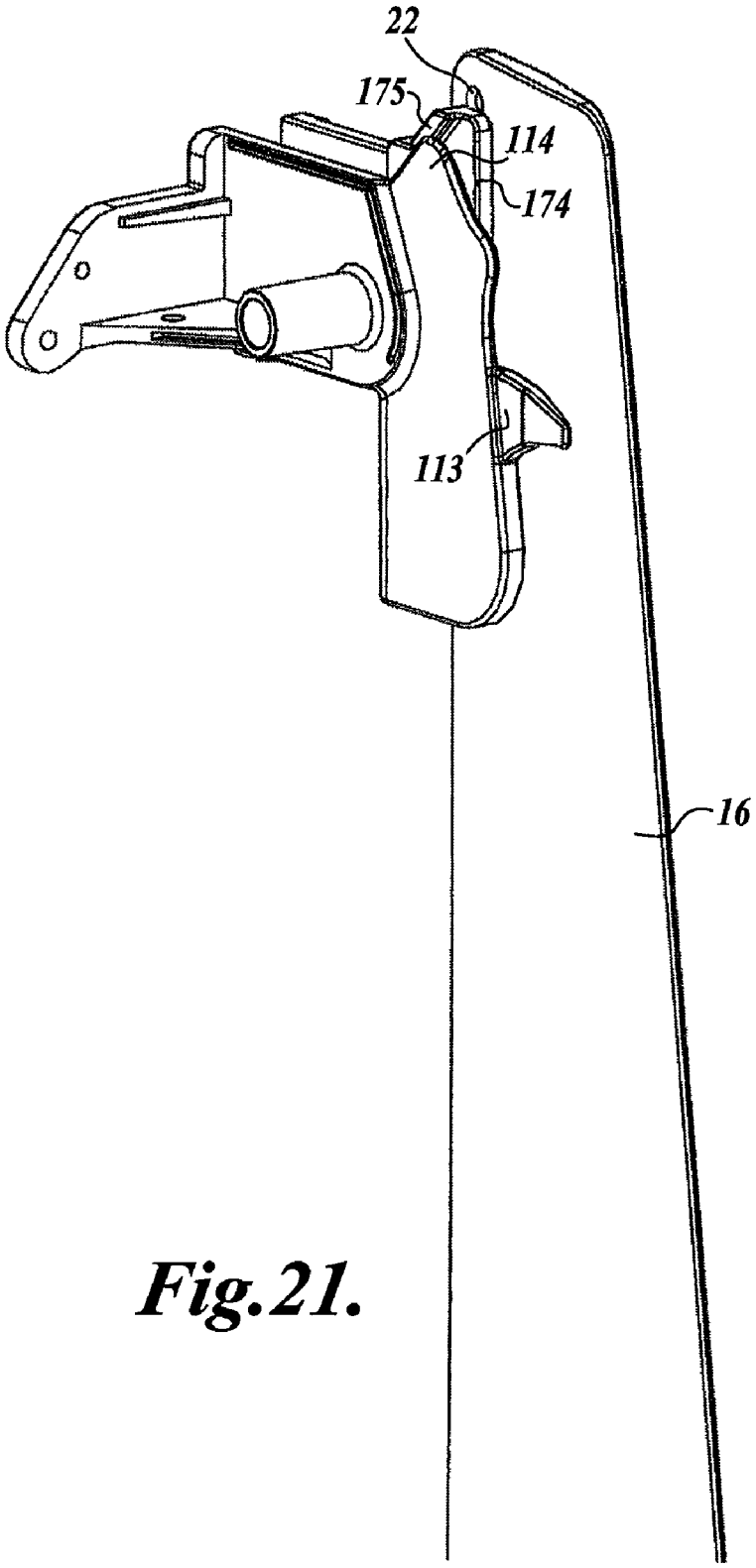
FIG. 21 is another corresponding top rear perspective with parts in different positions.

As shown in FIG. 19, when the parts are assembled, i.e., with the stop resting on the internal roller, the stop flanges 175 are immediately adjacent to the leading edges of the projecting portions 114. These parts cooperate to provide an important safety feature that may protect the rudder blade or other parts of the assembly from damage if the blade contacts an obstacle while the watercraft is moving backwards. In that case, the bottom of the blade will be forced forward in the general direction of the arrow A in FIG. 19. The blade will try to rotate clockwise around the internal roller, which has the effect of tending to move the very top of the rudder rearward. Flanges 175 engage against the leading edges of the projections 114 and, with some inherent resistance, slide upward as seen in FIG. 20. In the position of FIG. 20, the stop and top of the rudder are raised as compared to the position shown in FIG. 19. The upward and counter-clockwise swinging motion is opposed somewhat by the torsion springs and also by the angling of the flanges 175 and cooperating leading edges of the projections 114, but not so much as to prevent such movement if sufficient force is applied that damage to the assembly may occur. FIG. 21 shows the positions of the parts as the top edge of the rudder is forced upward and rearward even more due to engagement of the bottom portion of the rudder with an obstacle. Ultimately, the flanges 175 slide completely over the projections 114, whereupon the tendency is for the rudder to shift downward. At this point the bottom portion of the stop 174 engages the top edges of the tail pieces 113. The first engagement is inside the central groove 48 where the bottom portion of the stop engages against inward projecting shoulders 116 of the tail pieces 113 (such shoulders 116 being visible in FIG. 18). The torsion springs exert a fairly strong force tending to return the rudder blade to its normal vertical position and also limit how far rearward and upward the upper portion of the rudder can move. When the obstacle is past, the rudder automatically snaps back to its normal operating position.

If an obstacle is encountered while the kayak is moving forward, the rudder simply rotates upward out of the way, in the same manner as if it were retracted manually by pulling on the cord attached at 22. The torsion springs will return the rudder to the normal operating position when the kayak passes over the obstacle.

Another convenient aspect of a rudder assembly in accordance with the present invention is that the rudder blade with its stop piece can be quickly and easily removed from the kayak. This is achieved by simply pulling back on the mounting frames and sliding the rudder blade upward until it is separated from the rest of the mounting assembly. The rudder blade then can be stowed inside the kayak or at any convenient location.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A rudder assembly comprising:

an elongated rudder blade having leading and trailing edges, opposite side faces, and top and bottom ends;

a stop member affixed to the blade near the top end and having a portion projecting forward beyond the leading edge thereof;

a frame extending along a portion of the trailing edge of the blade and forward along the opposite side faces of the blade, the frame forming a slot and the blade being slideable lengthwise through the slot in the frame;

a mounting block having a groove receiving a portion of the leading edge of the blade opposite the portion of the trailing edge along which the frame extends, the mounting block having a pivot component for engagement against the forward projecting portion of the stop member such that the blade is rotatable from an upright steering position with the stop member engaged against the pivot component toward a horizontal retracted position; and a spring connected between the mounting block and the frame, the spring biasing the frame toward a position in which the blade received in the slot therein extends in the upright steering position but allowing upward rotation of the blade and frame relative to the mounting block followed by lengthwise translation of the blade relative to the frame and mounting block.

2. The rudder assembly of claim 1, in which the pivot component is a roller received in the groove of the mounting block, the stop member having an arcuate cut-out for resting on the roller when the blade is in the upright steering position.

3. The rudder assembly of claim 1, in which the mounting block is adapted for mounting on the stern of a personal watercraft for swinging about an upright axis.

4. The rudder assembly of claim 1, in which the spring constitutes the only mechanical connection between the frame and the mounting block.

5. The rudder assembly of claim 1, in which the blade is not mechanically attached to the frame and is not mechanically attached to the mounting block.

6. The rudder assembly of claim 1, in which the mounting block has an enclosed area with adjustable clamp blocks adapted for connection of a steering control line.

7. The rudder assembly of claim 1, in which the rudder blade and stop member are adapted for connection at different locations along the leading edge of the blade, whereby the depth of the blade below the mounting block can be adjusted by changing the location of attachment of the stop member to the rudder blade.

8. The rudder assembly of claim 1, in which the stop member and mounting block have cooperating components to permit limited swinging of the rudder blade in the direction opposite the direction of retraction.

9. The rudder assembly of claim 8, in which the cooperating components include inclined flanges on the stop member and cooperating inclined projection edges on the mounting block, such flanges and edges being immediately adjacent to each other when the rudder blade is in the upright steering position.

10. The rudder assembly of claim 1, in which the blade tapers in width from its bottom end to its top end, and the frame being biased against the trailing edge of the blade to hold it engaged in the groove of the mounting block, such that lengthwise shifting of the blade in the frame slot results in changing the relative positions of the frame and the mounting block.

11. The rudder assembly of claim 1, in which the spring is a helical torsion spring having a helical body and a first spring arm mounted on the mounting block, the torsion spring having a second spring arm secured to the frame.

12. A rudder assembly comprising:

an elongated rudder blade having leading and trailing edges, opposite side faces, and top and bottom ends, the blade being tapered from its bottom end toward its top end such that the distance between the trailing and leading edges decreases;

a stop member affixed to the blade near the top end and having a portion projecting forward beyond the leading edge thereof, the rudder blade and stop member being adapted for connection at different locations along the leading edge of the blade, whereby the depth of the blade below the stop member can be adjusted by changing the location of attachment of the stop member to the rudder blade;

a frame extending along a portion of the trailing edge of the blade and forward along the opposite side face of the blade, the frame forming a slot and the blade being slideable lengthwise through the slot in the frame;

a mounting block adapted for mounting on the stern of a personal watercraft for swinging about an upright axis, the mounting block having a groove receiving a portion of the leading edge of the blade opposite the portion of the trailing edge along which the frame extends, the frame being biased toward the portion of the mounting block groove receiving the leading edge of the blade such that sliding of the tapered blade in the frame slot shifts the position of the frame relative to the block, the mounting block having a pivot component for engagement against the forward projecting portion of the stop member such that the blade is rotatable from an upright steering position with the stop member engaged against the pivot component toward a horizontal retracted position, the pivot component being a roller received in the groove of the mounting block, the stop member having an arcuate cut-out for resting on the roller when the blade is in an upright steering position, the mounting block having an enclosed area with adjustable clamp blocks adapted for connection of a steering control line; and a spring connected between the mounting block and the frame, the spring biasing the frame toward a position in which the blade received therein extends in the upright steering position but allows upward rotation of the blade and frame relative to the mounting block followed by lengthwise translation of the blade relative to the frame and mounting block, the spring being a helical torsion spring constituting the only mechanical connection between the frame and the mounting block and having a helical body and a first spring arm mounted on the mounting block, the torsion spring having a second spring arm secured to the frame, the stop member and mounting block having cooperating components to permit limited swinging of the rudder blade in the direction opposite the direction of retraction, the cooperating components including inclined flanges on the stop member and cooperating inclined projection edges on the mounting block, such flanges and edges being immediately adjacent to each other when the rudder blade is in the upright steering position.

13. The rudder assembly of claim 12, in which the blade is not mechanically attached to the frame and is not mechanically attached to the mounting block.

* * * * *

UNITED STATES PATENT AND TRADEMARK OFFICE

CERTIFICATE OF CORRECTION

PATENT NO. : 8,210,114 B2
APPLICATION NO. : 13/022476
DATED : July 3, 2012
INVENTOR(S) : M. A. Nysether et al.

It is certified that error appears in the above-identified patent and that said Letters Patent is hereby corrected as shown below:

In the Claims

| COLUMN | LINE | ERROR |
|---|---|---|
| 8 (Claim 12) | 15 | "side face" should read --side faces-- |

Signed and Sealed this
Fourth Day of March, 2014

Michelle K. Lee

Michelle K. Lee
*Deputy Director of the United States Patent and Trademark Office*